US006112755A

United States Patent [19]

Lin et al.

[11] Patent Number: 6,112,755

[45] Date of Patent: Sep. 5, 2000

[54] AUTOMATIC PENTA-FOLD UMBRELLA

[75] Inventors: Chung-Kuang Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/215,635

[22] Filed: Dec. 15, 1998

[51] Int. Cl.[7] ..... A45B 25/14

[52] U.S. Cl. ..... 135/24; 135/20.3; 135/22; 135/25.3; 135/28

[58] Field of Search ..... 135/24, 22, 23, 135/25.1, 25.3, 25.33, 25.4, 28, 40, 20.3

[56] References Cited

U.S. PATENT DOCUMENTS

| | | | |
|---|---|---|---|
| 5,390,686 | 2/1995 | Lin et al. | 135/24 |
| 5,441,065 | 8/1995 | Lin et al. | 135/24 |
| 5,492,140 | 2/1996 | Lin et al. | 135/24 |
| 5,505,222 | 4/1996 | Lin et al. | 135/24 |
| 5,617,889 | 4/1997 | Wu | 135/24 X |
| 5,626,161 | 5/1997 | Lin et al. | 135/24 |
| 5,645,094 | 7/1997 | Wu | 135/24 |
| 5,803,102 | 9/1998 | Ko | 135/24 |
| 5,823,215 | 10/1998 | Chou et al. | 135/24 |

*Primary Examiner*—Carl D. Friedman
*Assistant Examiner*—Winnie Yip

[57] ABSTRACT

An automatic umbrella includes a central shaft consisting of five tubes telescopically engageable with one another; a rib assembly consisting of at least a top rib pivotally secured to a top portion of the central shaft, a stretcher rib pivotally connected with the top rib and a lower runner slidably held on the central shaft, and plural ribs pivotally connected to the top rib and the stretcher rib; an opening spring resiliently retained in the central shaft for opening the umbrella; a plurality of closing springs secured on the rib assembly for closing the umbrella; and a control device consisting of an upper roller rotatably mounted on an upper portion of the central shaft, at least a lower roller rotatably secured on the lower runner and at least an uppermost roller rotatably secured on a top portion of the shaft for continuously deflectively winding at least a rope of the control device on the respective rollers for making an automatic umbrella of penta-fold or the like.

12 Claims, 10 Drawing Sheets

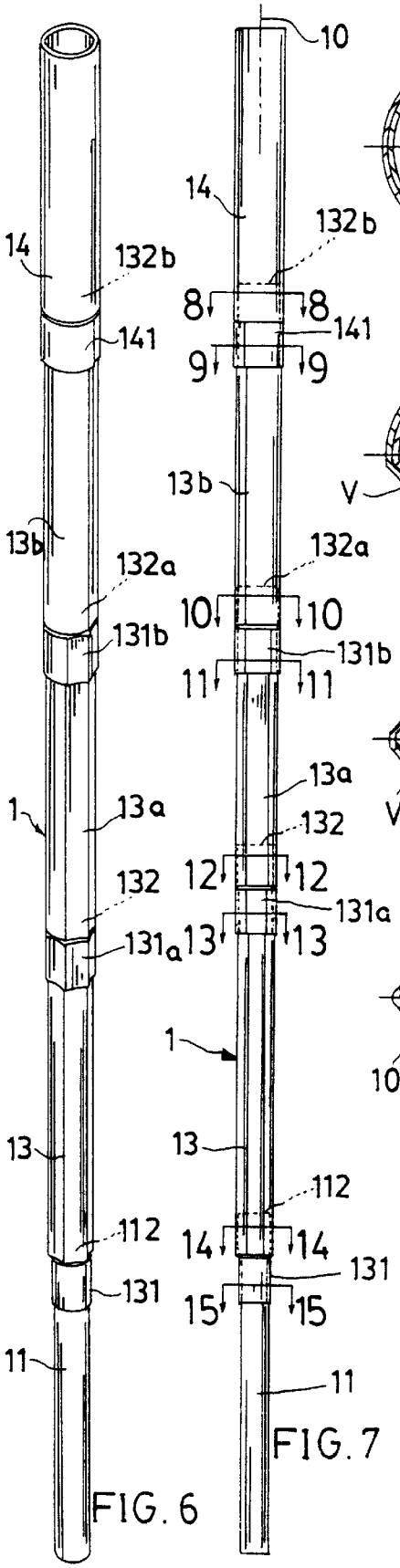
FIG. 6
FIG. 7
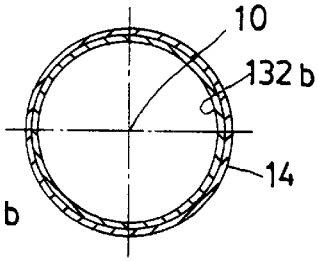
FIG. 8
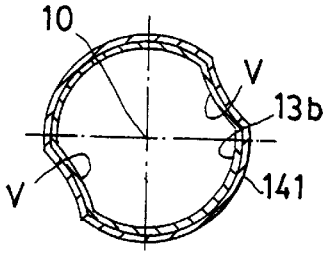
FIG. 9
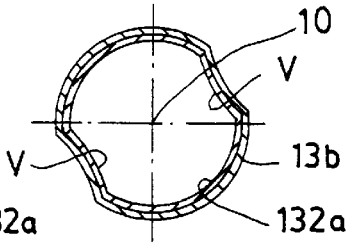
FIG. 10
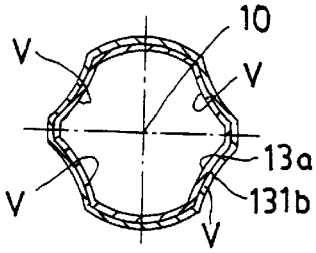
FIG. 11
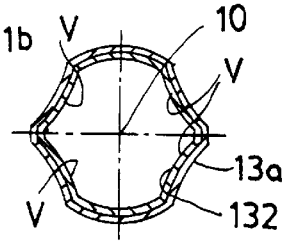
FIG. 12
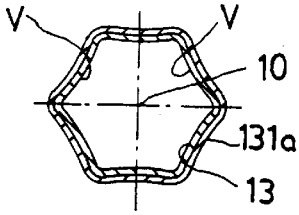
FIG. 13
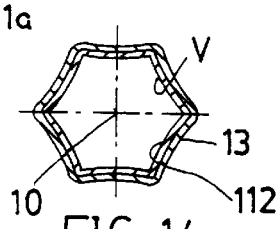
FIG. 14
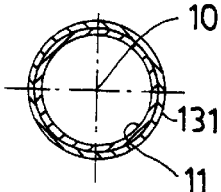
FIG. 15
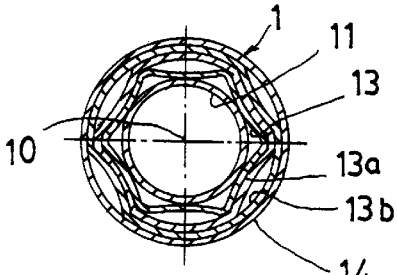
FIG. 16

AUTOMATIC PENTA-FOLD UMBRELLA

BACKGROUND OF THE INVENTION

U.S. patent application with Ser. No. 09/071,439 filed on May 1, 1998 by the same inventors of this application disclosed an automatic umbrella with quadruple folds. In order to further shorten the length and minimize the volume of the folded umbrella, the umbrella structure and mechanism may be modified to be penta-fold, thereby forming a compact umbrella easily and conveniently carried or stored.

SUMMARY OF THE INVENTION

The object of the present invention is to provide an automatic umbrella including a central shaft consisting of five tubes telescopically engageable with one another; a rib assembly consisting of at least a top rib pivotally secured to a top portion of the central shaft, a stretcher rib pivotally connected with the top rib and a lower runner slidably held on the central shaft, and plural ribs pivotally connected to the top rib and the stretcher rib; an opening spring resiliently retained in the central shaft for opening the umbrella; a plurality of closing springs secured on the rib assembly for closing the umbrella; and a control device consisting of an upper roller rotatably mounted on an upper portion of the central shaft, at least a lower roller rotatably secured on the lower runner and at least an uppermost roller rotatably secured on a top portion of the shaft for continuously deflectively winding at least a rope of the control device on the respective rollers for making an automatic umbrella of penta-fold or the like.

BRIEF DESCRIPTION OF THE DRAWINGS

FIG. 6 is a perspective view of the plural tubes of the central shaft of the present invention.

FIG. 7 is a front view of the central shaft of FIG. 6.

FIG. 8 is a cross sectional drawing when viewed from 8—8 direction of FIG. 7.

FIG. 9 is a cross sectional drawing when viewed from 9—9 direction of FIG. 7.

FIG. 10 is a cross sectional drawing when viewed from 10—10 direction of FIG. 7.

FIG. 11 is a cross sectional drawing when viewed from 11—11 direction of FIG 7.

FIG. 12 is a cross sectional drawing when viewed from 12—12 direction of FIG. 7.

FIG. 13 is a cross sectional drawing when viewed from 13—13 direction of FIG. 7.

FIG. 14 is a cross sectional drawing when viewed from 14—14 direction of FIG. 7.

FIG. 15 is a cross sectional drawing when viewed from 15—15 direction of FIG. 7.

FIG. 16 is a cross sectional drawing of the central shaft of the present invention when folded.

DETAILED DESCRIPTION

Figure 1:
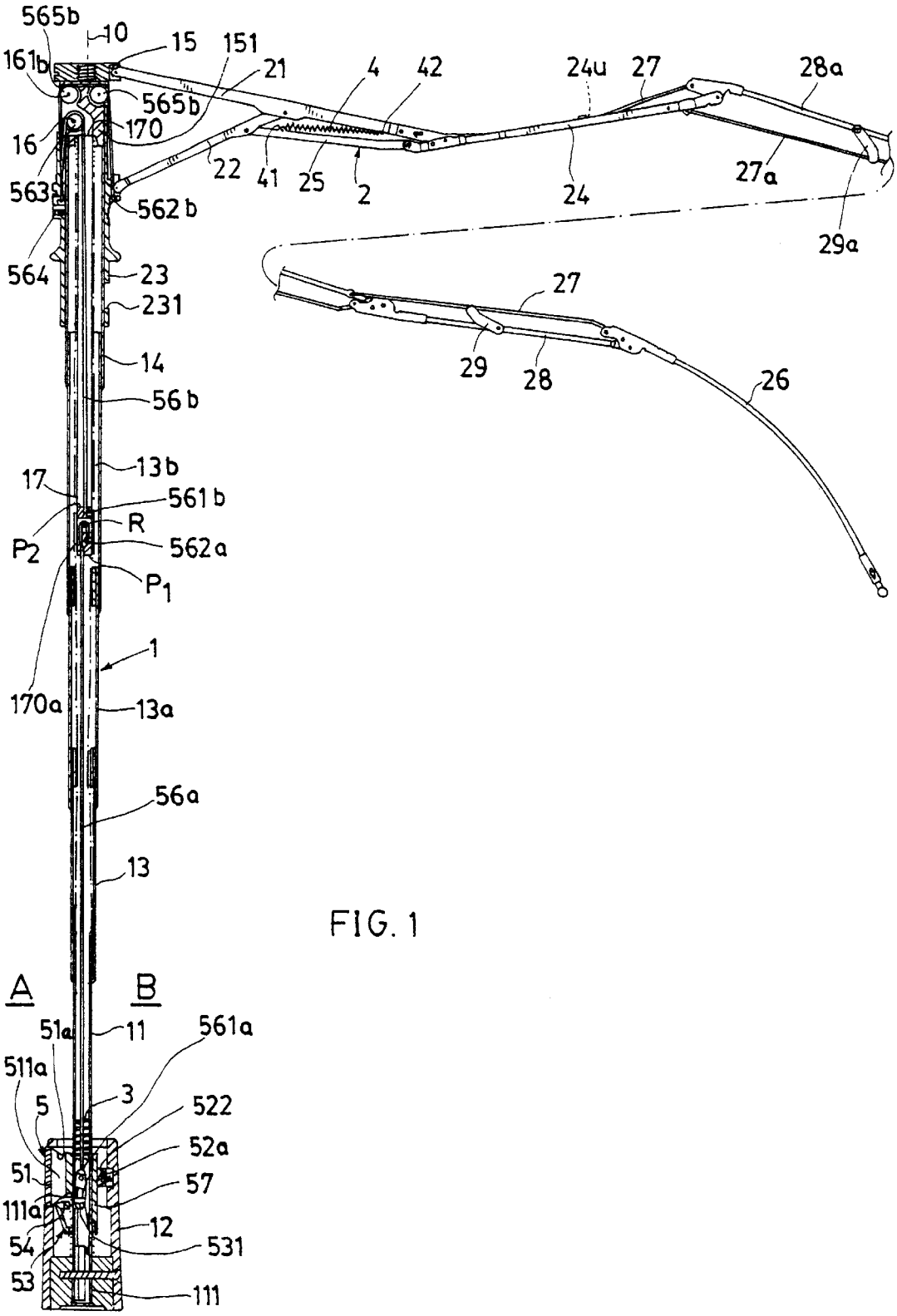
FIG. 1 is an illustration showing an opened umbrella in accordance with the present invention.

As shown in FIGS. 1–16, the present invention comprises: a central shaft 1, a rib assembly 2, an opening spring 3, a plurality of closing springs 4, and a control means 5. The central shaft 1 includes: a lower tube 11, a grip 12 secured to a lower tube portion 111 of the lower tube 11, a first middle tube 13 slidably held on an outer and upper side of the lower tube 11, a second middle tube 13*a* slidably held on an outer and upper side of the first middle tube 13, a third middle tube 13*b* slidably held on an outer and upper side of the second middle tube 13*a*, an upper tube 14 slidably held on an outer and upper side of the third middle tube 13*b*, an upper notch 15 secured on a top portion of the upper tube 14, and a central sleeve 17 having an uppermost sleeve portion 170 secured to an inner block 151 at an upper portion of the upper tube 14.

The rib assembly 2 includes: a top rib 21 having an inner portion of the top rib 21 pivotally secured to the upper notch 15 of the central shaft 1, a stretcher rib 22 having an outermost rib end pivotally connected with a middle portion of the top rib 21 and having an inner portion of the stretcher rib 22 pivotally secured to a lower runner 23 which is slidably held on the upper tube 14 and having an outer rib portion of the stretcher rib 22 pivotally connected with an inner portion of an inner connecting rib 25, an intermediate rib 24 having an inner portion thereof pivotally connected to an outermost end of the top rib 21 and having an innermost end of the intermediate rib 24 pivotally connected with an outer end of the inner connecting rib 25, having an inner end of the inner connecting rib 25 pivotally connected with an outer portion of the stretcher rib 22, a tail rib 26 having an inner portion pivotally connected with an outer portion of an outer connecting rib 28 and having an innermost end of the tail rib 26 pivotally connected with an outer end of an outer spring rib 27 juxtapositioned to the outer connecting rib 28 with the outer spring rib 27 having an inner end thereof pivotally connected with an outer portion of a middle connecting rib 28*a*, an inner spring rib 27*b* juxtapositionally held to the intermediate rib 24 and connected between an innermost end of the middle connecting rib 28*a* and an outer portion of the top rib 21, the outer connecting rib 28 juxtapositionally coupled with the outer spring rib 27 by a first coupling 29, having an inner portion of the outer connecting rib 28 pivotally connected with an outermost end of the middle connecting rib 28*a* and having an outer end of the outer connecting rib 28 pivotally connected to an inner portion of the tail rib 26, and having an innermost end of the outer connecting rib 28 pivotally connected with an outer end of a middle spring rib 27*a*, of which an inner spring end is pivotally connected to an outer portion of the intermediate rib 24, with the middle connecting rib 28*a* juxtapositionally coupled with the middle spring rib 27*a* by a second coupling 29*a* and having an inner portion of the middle connecting rib 28*a* pivotally connected with an outermost end of the intermediate rib 24.

Other mechanisms of the ribs can be modified. The lower runner 23 has a lower extension tube 230 protruding downwardly from the runner 23 having a slot 231 cut through the extension tube 230.

The coupling 29 as shown in FIGS. 1, 2, 3 and 5 includes a pivot 291 formed on a base of the coupling for pivotally securing the coupling 29 on the outer connecting rib 28, a pin 292 formed on an end portion of the coupling for pivotally connecting a middle loop formed on a middle portion of the outer spring rib 27, and a seat portion 293 formed on a central portion of the coupling for resting the outer spring rib 27 thereon when the umbrella is folded. The spring rib 27 may also be separated as two spring sections to be commonly coupled to the pin 292 of the coupling. The second coupling 29*a* is provided for coupling the middle spring rib 27*a* with the middle connecting rib 28*a*.

Figure 4:
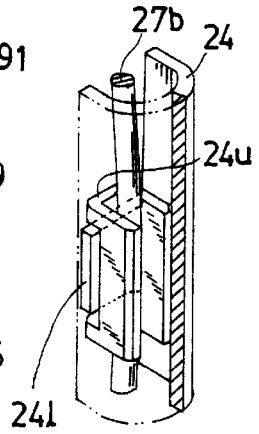
FIG. 4 shows a sliding engagement of the inner spring rib with the intermediate rib of the present invention.
Figure 5:
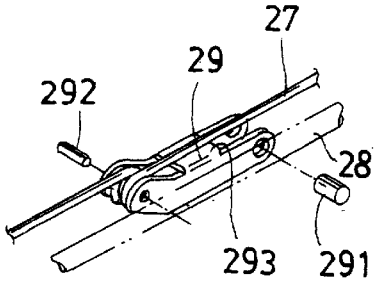
FIG. 5 shows a coupling for connecting the outer spring rib with the outer connecting rib of the present invention.

As shown in FIG. 4, a U-shaped guiding member 24*u* is retained in a middle portion of the intermediate rib 24 by a crimped lug 241 bent from an edge portion of the intermediate rib 24 for slidably holding the inner spring rib 27*b* in the guiding member 24*u* fixed on the intermediate rib 24. The guiding member 24*u* may be made of PVC or other plastic material for a smooth operation for folding or unfolding the umbrella and for preventing noise therefrom.

The coupling 29, 29*a* of the the present invention will respectively couple the spring rib 27, 27*a* with the connecting rib 28, 28*a* to prevent twisting, tangling or inversion of the two ribs 27, 28 (27*a*, 28*a*) for a smooth folding and unfolding operation of the rib assembly 2.

The central shaft means 1 (especially shown in FIGS. 6~16) includes: the lower tube 11 having an upper enlarged portion 112 having a cross section of hexagonal shape with six recesses V slightly concave inwardly to be engageable with the first middle tube 13 having a cross section of hexagonal shape with six recesses V slightly concave inwardly, the first middle tube 13 having an upper enlarged portion 132 having a cross section of general cross shape having four recesses V diagonally recessed inwardly towards the axis 10 of the shaft 1 to be engageable with the second middle tube 13*a* having a cross section of general cross shape having four recesses V diagonally recessed inwardly towards the axis 10 and having a lower tube end 131 tapered downwardly to have a cross section of circular shape to be engageable with the lower tube 11 with circular shape, the second middle tube 13*a* having a lower tube end 131*a* tapered downwardly and having a cross section of hexagonal shape to be engageable with the first middle tube 13 and having an upper enlarged portion 132*a* having a cross section of two-lobe shape with two recesses V recessed diametrically towards the axis 10 to be engageable with the third middle tube 13*b* having a cross section of two-lobe shape, the third middle tube 13*b* having a lower tube end 131*b* tapered downwardly to have a cross section of general cross shape having four recesses V diagonally recessed inwardly to be engageable with the second middle tube 13*a* and having an upper enlarged portion 132*b* having a cross section of circular shape to be engageable with the upper tube 14 having a cross section of circular shape, and the upper tube 14 having a lower tube end 141 tapered downwardly to have a cross section of two-lobe shape having two recesses V diametrically recessed inwardly to be engageable with the third middle tube 13*b*.

Other cross sectional shapes of the tubes of the central shaft means 1 may be further modified in the present invention.

The opening spring 3 for opening an umbrella of this invention has a lower spring end 31 retained on a lower protrusion portion 10*a* of the lower tube 11, and an upper spring end 32 retained in an inner block 151 inserted in an upper portion of the upper tube 14, with the opening spring 3 slidably disposed about the central sleeve 17.

Each closing spring 4 of the plurality of the closing springs 4 has an inner spring end 41 of the closing spring 4 secured to an inner portion of the inner connecting rib 25, and an outer spring end 42 of the closing spring 4 secured to an outer portion of the top rib 21. The closing spring 4 is provided for closing an umbrella from its opened state by an elastic energy stored when opening the umbrella. The closing spring 4 may also be installed on the other locations of the rib assembly 2.

The control means 5 includes: a push button 51 resiliently held in a button hole 120*a* formed in the grip 12 having an upper latch 52*a* integrally formed on a ring portion 511 which is slidably held in at least a guiding groove 124 transversely recessed in an inside wall of the grip 12, with the ring portion 511 tapered from the push button 51 from a first side A of the central shaft 1 towards a second side B of the shaft 1 to form a pair of reinforced side-wing portions 51*a* disposed on opposite sides of the push button 51 and each wing portion 51*a* defined between the push button 51 and the ring portion 511, and having the upper latch 52*a* operatively actuated when simultaneously depressing the push button 51 for opening the umbrella, a closing controller 53 having a lower latch 54 resiliently secured on an anti-false operation safety means 57 resiliently held in the grip 12 and the lower latch 54 being operatively depressible by the push button 51 for inwardly pushing a locking head 551, which is secured with a lower rope 56*a* slidably wound in the central sleeve 17 with the lower rope 56*a* connectable with an upper rope 56*b* which is deflectively linked among an upper portion of the upper tube 14, the lower runner 23 and the central sleeve 17, for disengaging the locking head 551 from a detent protrusion 111*a* formed in a lower portion 111 of the lower tube 11, thereby allowing each said closing spring 4 to be restored to release its pre-stored elastic energy for closing the umbrella from an opened state, with the anti-false operation safety means 57 having an elongated cylinder 571 lowered by the middle tubes 13, 13*a* after closing the umbrella to lower the latch 54 to prevent a false depression of the closing controller 53 without being depressed by the push button 51.

Figure 3:
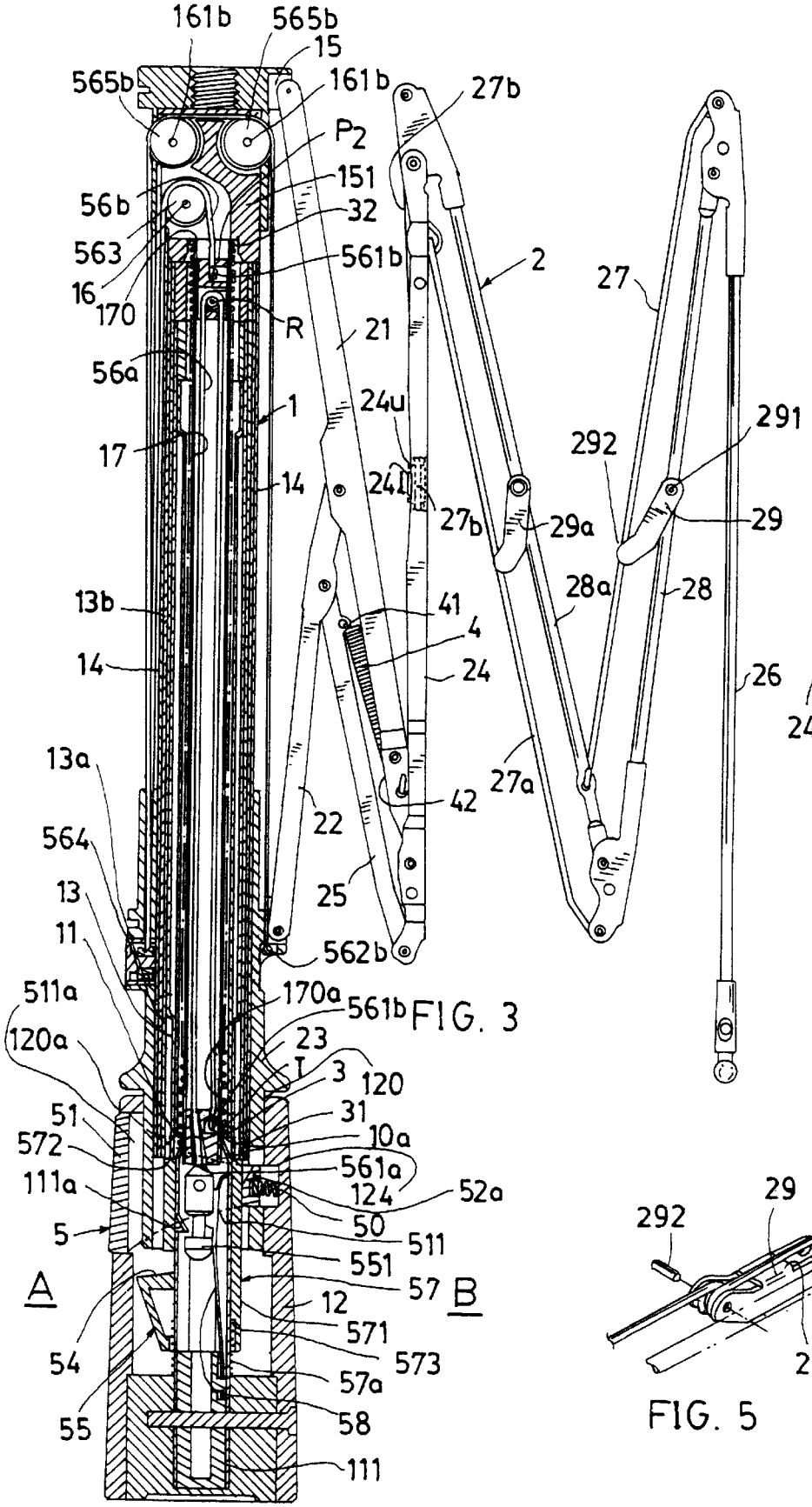
FIG. 3 is a sectional drawing showing a folded umbrella of the present invention.

The upper latch 52*a* as integrally formed on the ring portion 511 of the push button 51 includes: a sloping latch portion 522, adjacent to the second side B of the shaft 1, operatively depressed and retracted by the lower runner 23 when closing the umbrella, and the upper latch 52*a* having a spring socket recessed therein adjacent to the second side B of the shaft 1 to be resiliently urged towards the first side A of the shaft 1 by a restoring spring 50 retained in the spring socket and in the grip 12 adjacent to the second side B of the shaft 1 to be engageable with the slot 231 formed in the lower runner 23 for locking the umbrella at its folded state (FIG. 3).

The push button 51 has the ring portion 511 formed with a central hole 511*a* in a central portion of the ring portion 511 for downwardly passing the lower extension tube 230 of the lower runner 23 which is disposed around a bottom tube portion of each upper tube 14 and the middle tubes 13, 13*a*, 13*b* when folding the central shaft 1 for closing the umbrella (FIG. 3). The sloping latch portion 522 is tapered downwardly from an upper rim surface of the ring portion towards the central hole 511*a* to be thrusted or retracted when lowering the runner 23 for closing the umbrella. The restoring spring 50 will then urge the upper latch 52*a* for engaging the slot 231 in the runner 23 for locking the umbrella at its folded or closed state.

Upon an inward depression of the push button 51 to retract the upper latch 52*a* for disengaging the upper latch 52*a* from the slot 231 of the lower runner 23, the umbrella will be opened because the tubes of the shaft 1 and the lower runner 23 are resiliently tensioned by the opening spring 3 (FIG. 1).

The closing controller 53 includes: the lower latch 54 resiliently secured to a lower portion of an elongated cylinder 571 of the anti-false operation safety means 57, with the elongated cylinder 571 resiliently raised upwardly as urged by a tension spring 57*a* which is retained in a bottom spring socket 573 recessed in a bottom of the cylinder 571 to position the lower latch 54 in between the push button 51 and a locking head 551 secured with the lower rope 56*a* when opening the umbrella as shown in FIG. 1, with the central hole 511*a* in the ring portion 511 allowing an upwardly moving of the cylinder 571 and the lower latch 54 because the cylinder 571 is urged by the tension spring 57*a* after opening the umbrella to extend the upper and middle tubes 14, 13, 13*a*, 13*b* upwardly and raise the runner 23 as shown in FIG. 1, whereby upon depression of the push button to inwardly push the lower latch 54 and the locking head 551 through a latch hole formed in the lower tube 11, the locking head 551 will be disengaged from the detent protrusion 111*a* in the lower tube 11 for closing an umbrella from an opened state.

The detent protrusion 111*a* is directly punched inwardly from a lower portion of the lower tube 11 for engaging the locking head 551 when closing the umbrella and compressing the spring 3 as being sidewardly biased towards the first side A of the shaft 1 by a convex spring plate 58 formed in the grip 12 at the second side B of shaft 1 (FIG. 3).

The lower rope 56*a* has a lower rope end 561*a* secured to the locking head 551 and an upper rope end 562*a* secured to a lower plug P1 retained at a bottom 170*a* of the central sleeve 17; with the lower rope 56*a* extending upwardly from the locking head 551, passing through a rope hole T formed through the lower plug P1, an interior in the central sleeve 17, then deflectively wound on a miniature roller R rotatably secured in a sliding pulley P2 slidably held in the central sleeve 17, and finally downwardly secured with the lower plug P1. The rope hole T is tapered upwardly in the lower plug P1 to serve as a buffer and a smooth guide for the rope 56*a* in the plug P1 when closing the umbrella.

The upper rope 56*b* includes: an inner rope end 561*b* secured to the sliding pulley P2, an outer rope end 562*b* fixed to the lower runner 23, an upper guiding roller 563 rotatably mounted by an upper pivot 16 in the inner block 151 secured in an upper portion of the upper tube 14 for slidably guiding the upper rope 56*b* from the interior of the central sleeve 17 held in a central portion of the shaft 1, with the upper rope 56*b* wound on the upper guiding roller 563 and then deflected downwardly towards the lower runner 23 to be wound on a lower guiding roller 564 rotatably mounted on the lower runner 23 by a lower pivot 564*a*, a pair of uppermost guiding rollers 565*b* respectively rotatably mounted in opposite portions of the inner block 151 by two uppermost pivots 161*b* positioned above the upper guiding roller 563 for winding the upper rope 56*b*, as upwardly directed from the lower guiding roller 563, on the two uppermost guiding rollers 565*b* for disposing the upper rope 56*b* on opposite outer surfaces of the upper tube 14 for dynamically balancing the rope stroke when operating the umbrella, and with the outer rope end 562*b* downwardly directed to be fixed to the lower runner 23. So, the upper rope 56*b* (FIG. 3) is first wound on the upper roller 563 from the inside of the shaft 1 and guided to the lower roller 564 on the lower runner 23 by winding the rope on the lower guiding roller 564 and then deflectively extended upwardly to be wound on the two uppermost rollers 565*b* and finally deflected downwardly to be fixed to the lower runner 23, thereby providing an enough stroke for the upper rope 56*b* for "triple folds" of the penta-fold of the automatic umbrella; while the lower rope 56*a* deflectively wound on the miniature roller R in the sliding pulley P2 within the central sleeve 17 forming "two folds" of the umbrella, thereby making a total five folds (3+2=5) of the umbrella. The shaft 1 is consisting of five tubes (11, 13, 13*a*, 13*b* and 14) to form the penta-fold umbrella in combination with the ropes 56*a*, 56*b* and the ribs 2.

The anti-false operation safety means 57 includes: an elongated cylinder 571 slidably disposed around a lower portion of the lower tube 11 and resiliently rested on a tension spring 57*a* retained in a lower portion of the grip 12, the cylinder 571 having the lower latch 54 integrally formed on the cylinder 571, whereby when closing the umbrella, the lower runner 23 is lowered to insert the extension tube 230 into the inner hole 120 of the grip and the central shaft 1 is folded to lower the upper and middle tubes 14, 13, 13*a*, 13*b* to allow the bottom end of the middle tubes 13, 13*a* to downwardly press an annular top surface 572 of the cylinder 571 downwardly for compressing and restoring the spring energy of the tension spring 57*a*, whereby the runner 23 is locked by engaging the upper latch 52*a* with the slot 231 of the runner 23, and the lower latch 54 connected to the cylinder 571 is lowered to be positioned under the push button 51 as shown in FIG. 3 without being depressed by the push button. Therefore, upon depression of the push button 51 in order to open the umbrella, the lower latch 54 is positioned under and obstructed by the push button 51 to prevent unexpected actuation of the lower latch 54 of the closing controller 53 for preventing a false closing operation when opening the umbrella.

When opening the umbrella of the present invention as shown from FIG. 3 to FIG. 1, the push button 51 is depressed to disengage the upper latch 52*a* from the slot 231 formed in the runner 23 to release the opening spring 3, which is previously compressed when folding the umbrella for storing the elastic energy of the opening spring, to extend the tubes 14, 13*b*, 13*a* and 13 and raise the ribs and the runner 23 for opening the umbrella. The closing springs 4 are also tensioned to store their restoring elastic energy by the opening operation of the umbrella as effected by the opening spring 3.

Figure 2:
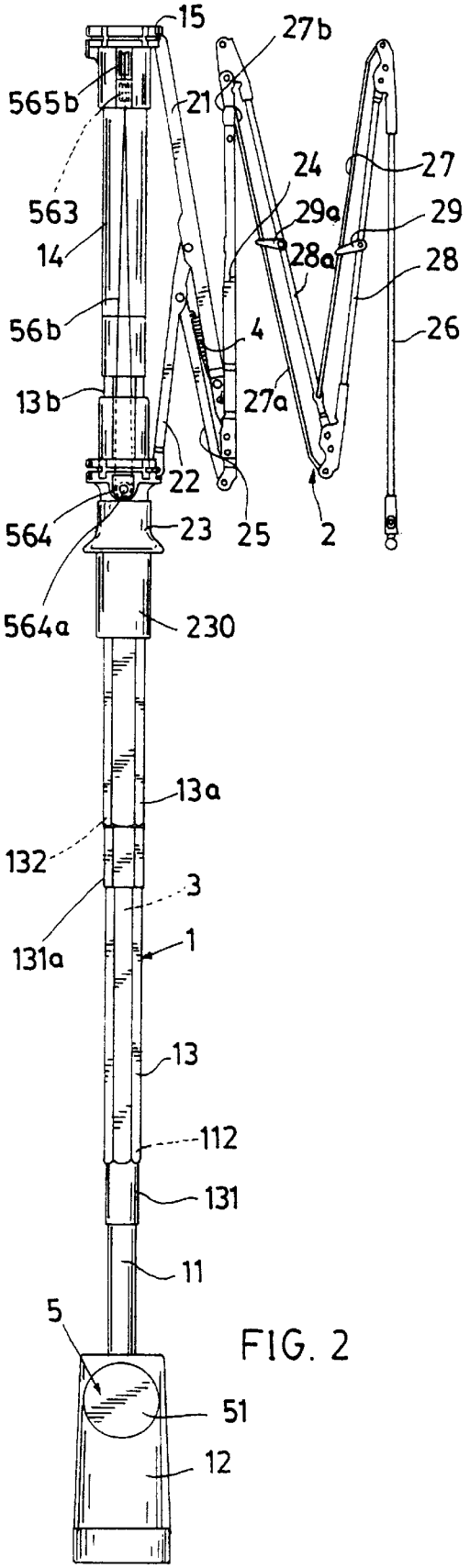
FIG. 2 shows an umbrella when folded from FIG. 1.

When closing the umbrella from FIG. 1 to FIG. 2, the push button 51 is depressed to force the lower latch 54 of the closing controller 53 towards the second side B of shaft 1 to disengage the locking head 551 from the detent protrusion 111*a* formed in the lower tube 11 to allow a downward movement of the runner 23 required for closing the umbrella, and the closing springs 4 will restore to lower the runner 23 to retract the ribs of the rib assembly 2 and fold the tubes 14, 13*b*, 13*a* 13, 11. Since the lower latch 54 and the cylinder 571 have already been moved upwardly as upwardly urged by the tension spring 57*a* (from FIG. 3 to FIG. 1) to be positioned between the push button 51 and the locking head 551 after opening the umbrella and raising the tubes 14, 13*b*, 13*a*, 13, there is no obstruction for the inward depression of the push button 51, thereby providing a normal closing operation of the umbrella (FIG. 1 to FIG. 2). For re-setting the folded or closed umbrella to store an elastic energy of the opening spring 3, the grip 12 may be depressed towards a tip portion of the umbrella for compressing the spring 3 ready for next opening use (FIG. 2 to FIG. 3).

Figure 17:
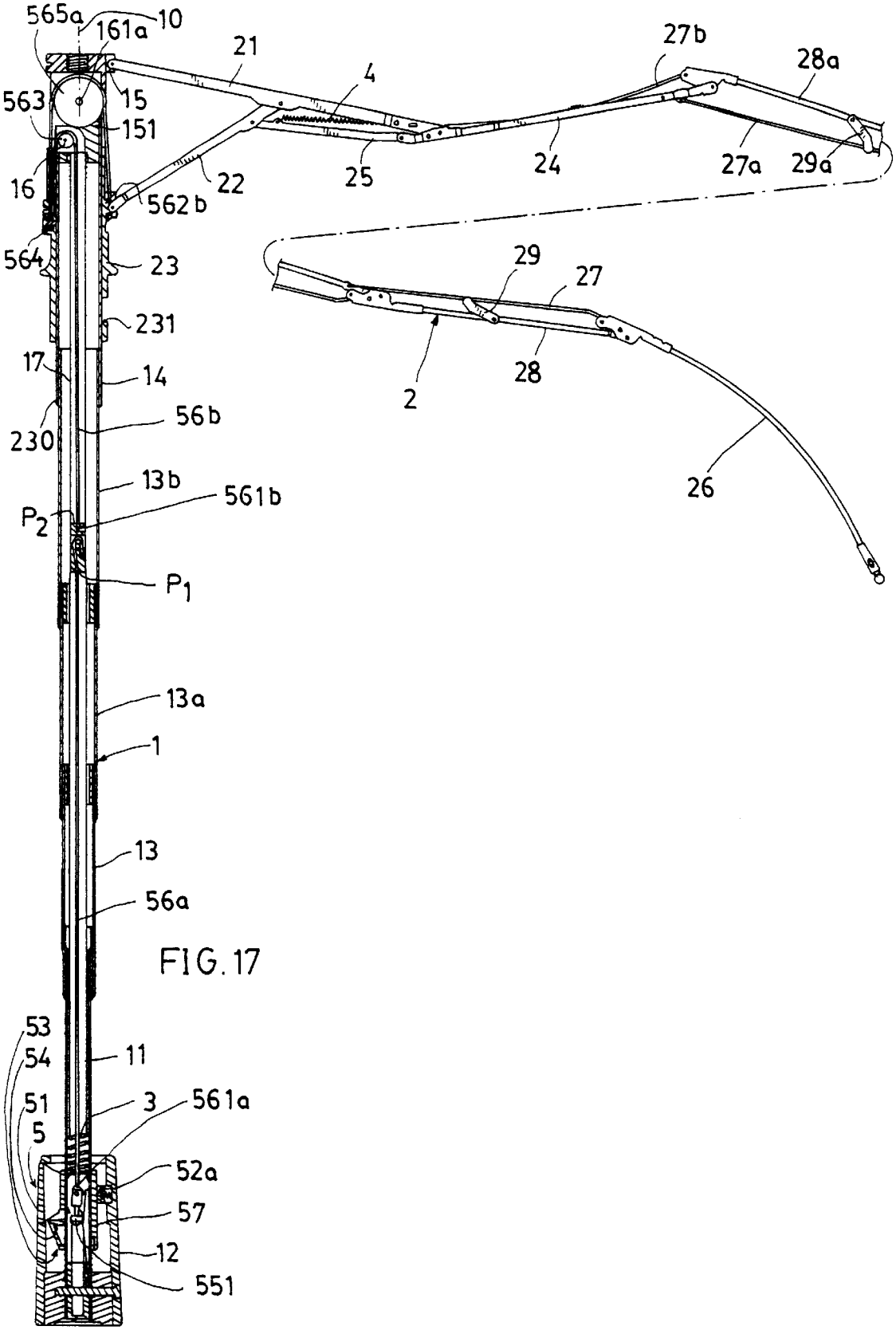
FIG. 17 shows an opened umbrella of another preferred embodiment of the present invention.
Figure 18:
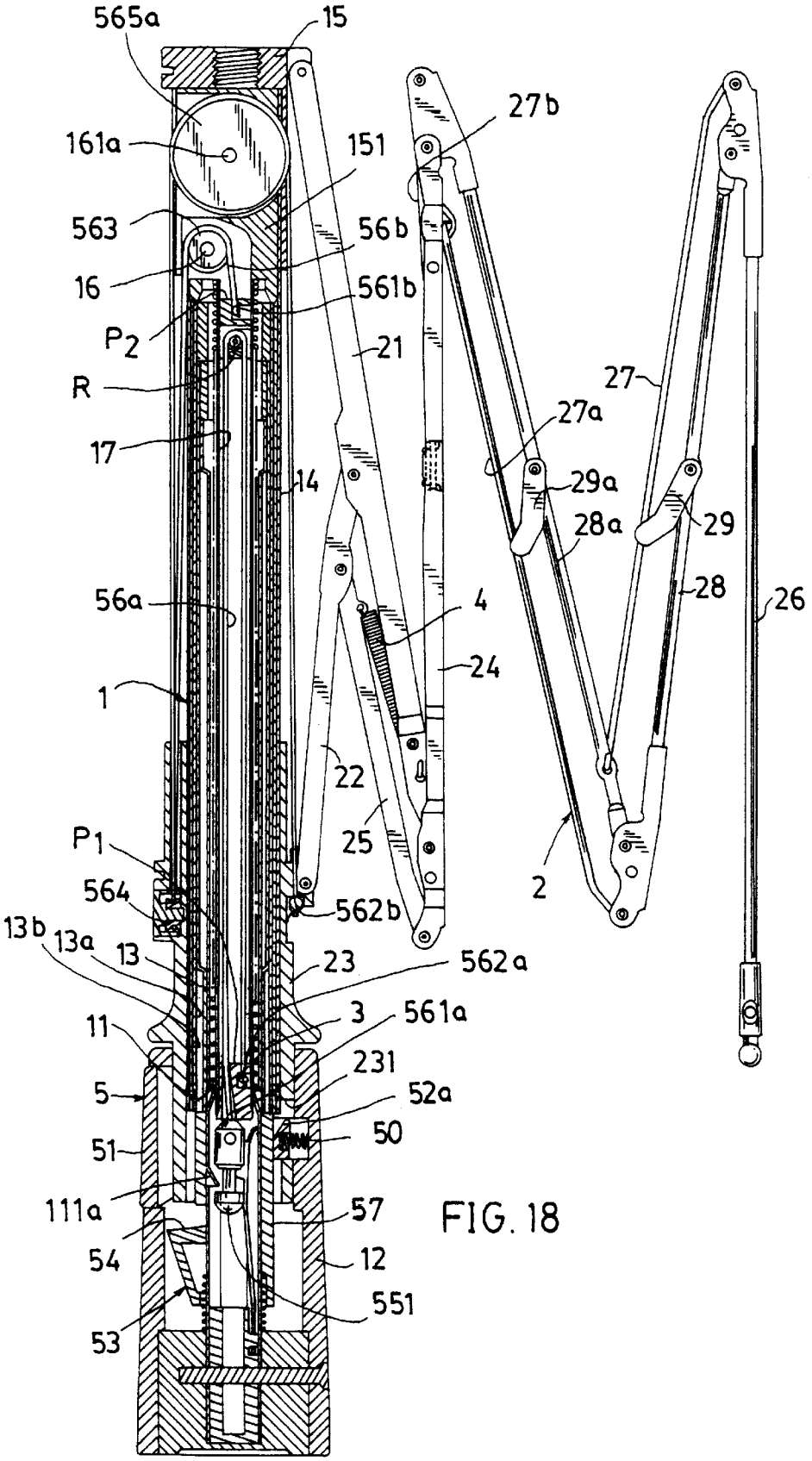
FIG. 18 is a sectional drawing of the umbrella when folded from FIG. 17.

The two uppermost guiding rollers 565*b* as shown in FIGS. 1~3 may be modified to be an uppermost guiding wheel 565*a* as shown in FIGS. 17, 18, in which the uppermost guiding wheel 565*a* has a diameter generally equal to a diameter of the upper tube 14 and rotatably mounted on the top of the upper tube 14 by an uppermost pivot 161*a* transversely secured on the top of the upper tube 14 and generally perpendicularly intersecting a longitudinal axis 10 of the shaft 1 for symmetrically disposing an outer rope section of the upper rope 56*b* on opposite sides of the pivot 161*a* of the wheel 565*a* and disposed on opposite outer surfaces of the upper tube 14 for dynamic balancing of the rope stroke when folding and unfolding the umbrella.

Figure 19:
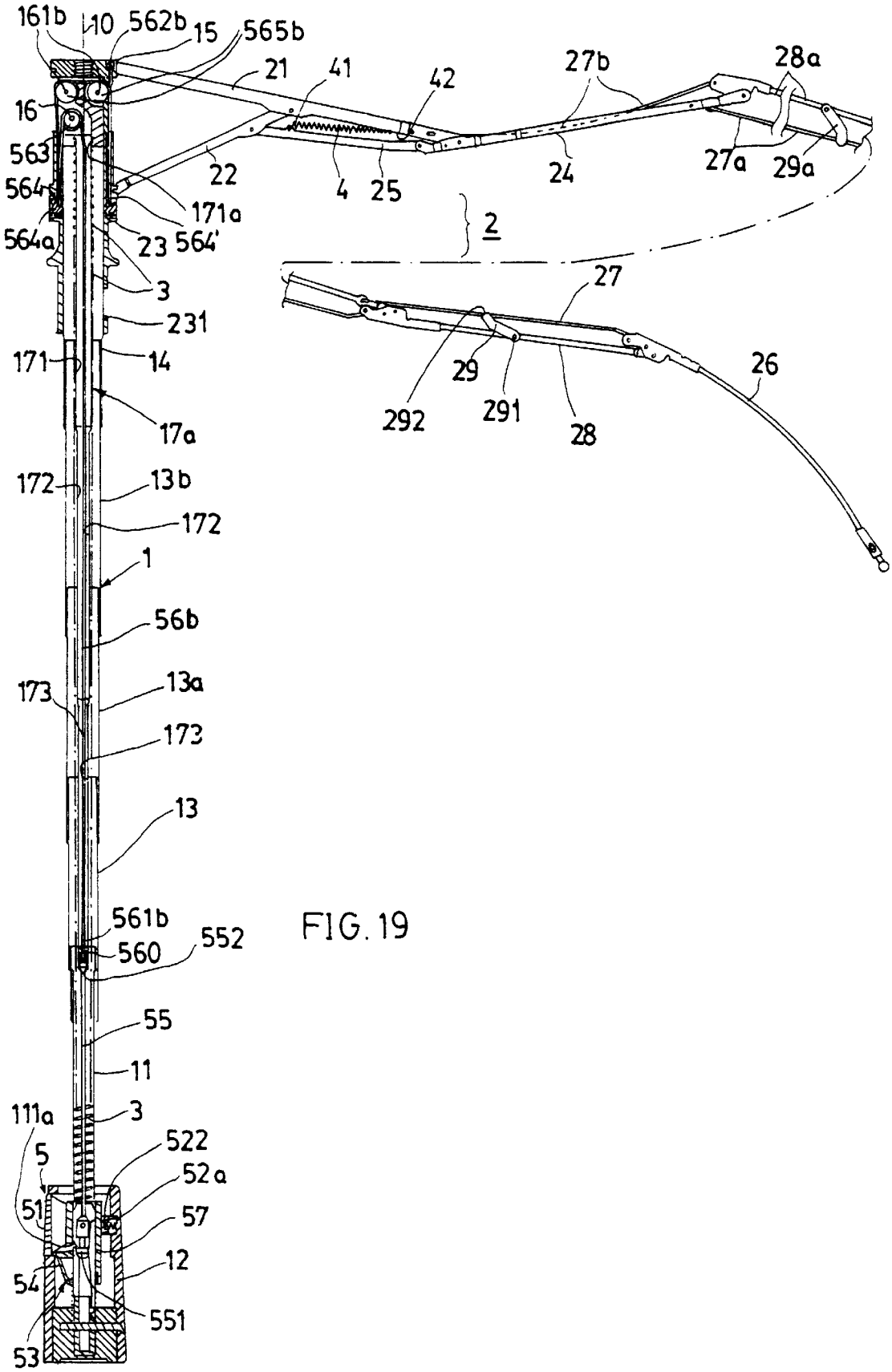
FIG. 19 shows an opened umbrella of still another preferred embodiment of the present invention.
Figure 20:
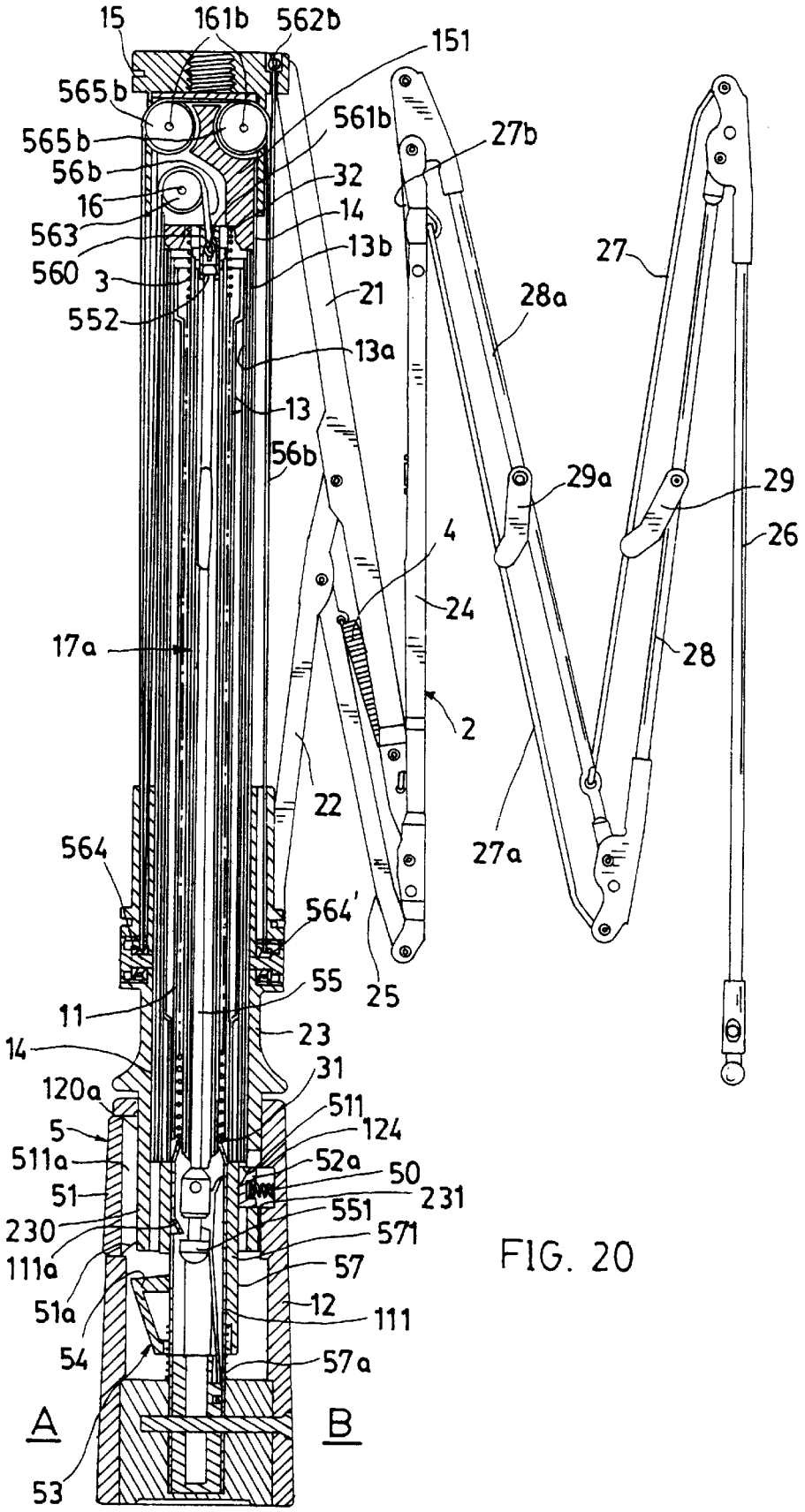
FIG. 20 is a sectional drawing of the umbrella when folded from FIG. 19.

As shown in FIGS. 19, 20, the present invention is modified from the preferred embodiment as illustrated in FIGS. 1~3, in which the locking head 551 is secured with a drag rod 55 coupled to an upper rope 56*b* which is deflectively linked among an interior in a central sleeve set 17*a*, an upper portion of the upper tube 14 and the lower runner 23, upon disengaging of the locking head 551 from a detent protrusion 111*a* formed in a lower portion 111 of the lower tube 11, each said closing spring 4 will be restored to release its pre-stored elastic energy for closing the umbrella from an opened state, with the anti-false operation safety means 57 having an elongated cylinder 571 lowered by the two middle tubes 13, 13*a* after closing the umbrella to lower the latch 54 to prevent a false depression of the closing controller 53 without being depressed by the push button when opening the umbrella.

The drag rod 55 has a lower rod end secured to the locking head 551 and an upper rod end 552 coupled to an inner rope end 561*b* of the upper rope 56*b* through a sliding coupling 560, with the drag rod 55 slidably held in the central sleeve set 17 consisting of an upper sleeve section 171, a middle sleeve section 172, and a lower sleeve section 173.

The upper rope 56*b* includes: an inner rope end 561*b* coupled to the drag rod 55 by the sliding coupling 560, an outer rope end 562*b* fixed to the upper notch 15 on a top of the shaft 1, an upper guiding roller 563 rotatably mounted by an upper pivot 16 in the inner block 151 secured in an upper portion of the upper tube 14 for slidably guiding the upper rope 56*b* from inside the upper tube 14 and the central sleeve set 17*a* telescopically held within the lower tube 11, the middle tubes 13, 13*a*, 13*b* and the upper tube 14 and winding the upper rope 56*b* on the upper guiding roller 563 with the rope 56*b* then directed downwardly towards the lower runner 23 to be wound on a first lower guiding roller 564 rotatably mounted on a first side (A) of the lower runner 23 by a lower pivot 564*a*, a pair of uppermost guiding rollers 565*b* respectively rotatably mounted in opposite portions of the inner block 151 by two uppermost pivots 161*b* above the upper guiding roller 563 for winding the upper rope 56*b* as upwardly directed from the first lower guiding roller 564 on the runner 23 on the two uppermost guiding rollers 565*b* for disposing the upper rope 56*b* on opposite outer surfaces of the upper tube 14 for dynamically balancing the rope stroke when operating the umbrella, with the outer rope end 562*b* downwardly directed to be wound on a second lower guiding roller 564' rotatably mounted on a second side (B) of the lower runner 23, and finally directed upwardly to be fixed on the upper notch 15 corresponding to the second side (B) of the runner 23. So, the upper rope 56*b* is first wound on the upper roller 563 from the inside of the shaft 1 and guided to the lower roller 564 on the lower runner 23 by winding the rope on the lower guiding roller 564 and then deflectively extended upwardly to be wound on the two uppermost rollers 565*b* and then deflected downwardly to be wound on another lower roller 564' and finally upwardly fixed to the upper notch 15, thereby providing an enough stroke for the rope for quadruple folds of five folds (4/5) of the automatic umbrella. Another fold (1/5) can be achieved by the drag rod 55 slid in the shaft 1 to make up five folds (4+1=5) of the umbrella.

Figure 21:
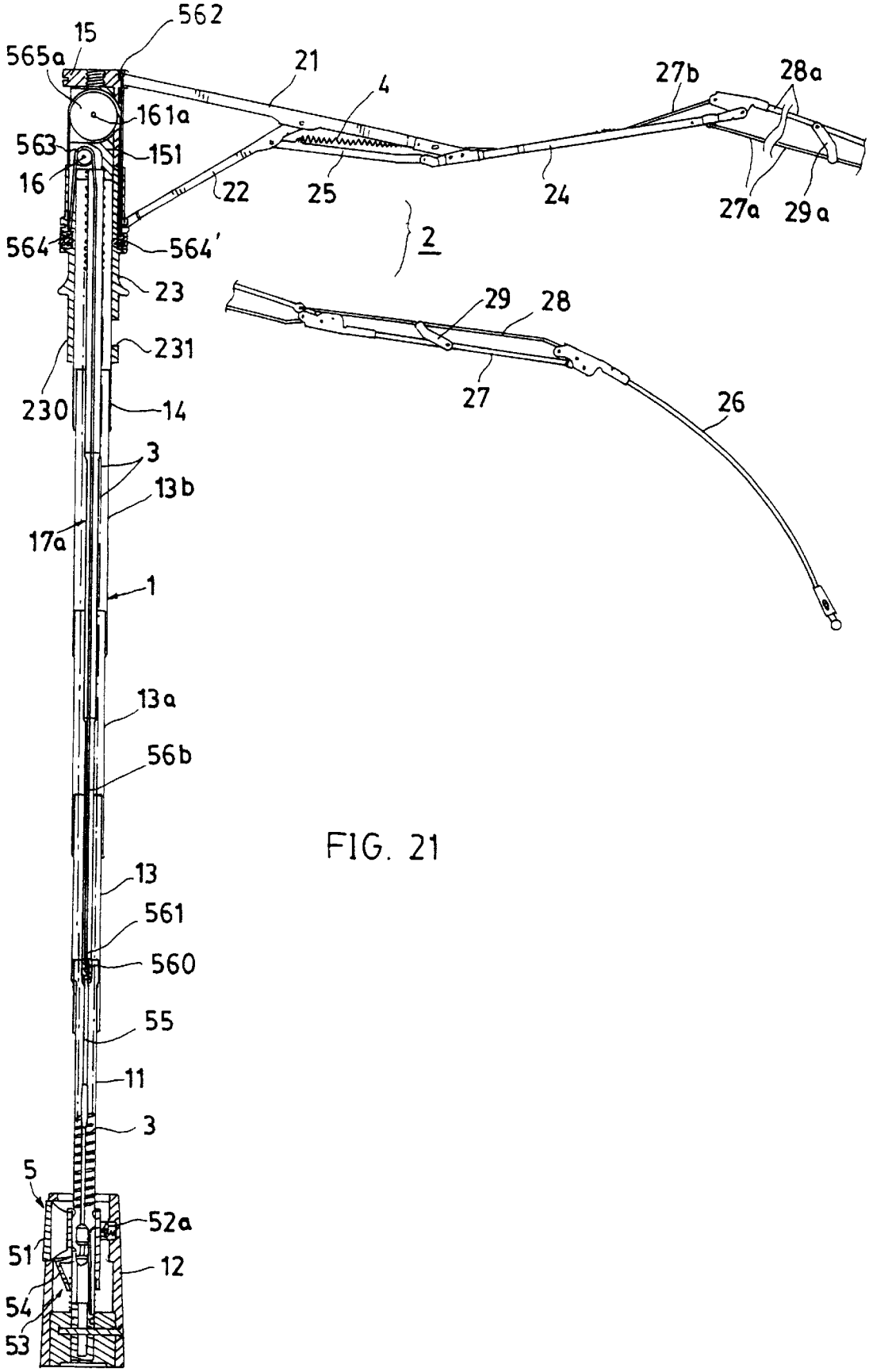
FIG. 21 shows an opened umbrella of further preferred embodiment of the present invention.
Figure 22:
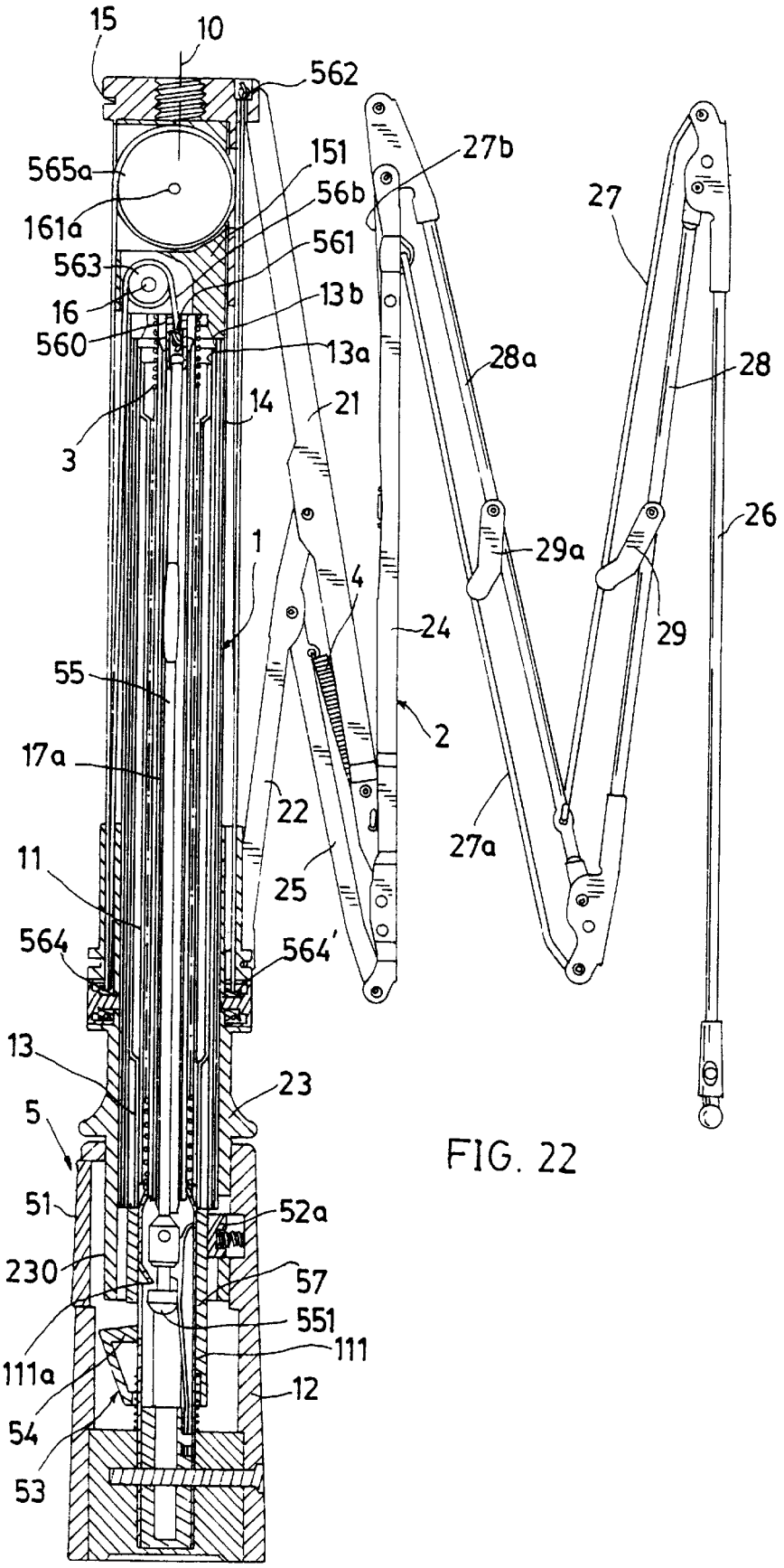
FIG. 22 is a sectional drawing of the umbrella when folded from FIG. 21.

The two uppermost guiding rollers 565*b* may be further modified from FIGS. 19, 20 to be an uppermost guiding wheel 565*a* as shown in FIGS. 21, 22, in which the uppermost guiding wheel 565*a* has a diameter generally equal to a diameter of the upper tube 14 and rotatably mounted on the top of the upper tube 14 by an uppermost pivot 161*a* transversely secured on the top of the upper tube 14 and generally perpendicularly intersecting a longitudinal axis 10 of the shaft means 1 for symmetrically disposing an outer rope section of the upper rope 56*b* on opposite sides of the pivot 161*a* of the wheel 565*a* and disposed on opposite outer surfaces of the upper tube 14 for dynamic balancing of the rope stroke when folding and unfolding the umbrella.

The present invention provides a five fold (penta-fold) automatic umbrella for minimizing a folding volume and shortening a length for a closed umbrella for a convenient carrying and storage, thereby being superior to the prior arts of multiple-fold or quadruple folds umbrella.

The present invention may be further modified without departing from the spirit and scope of the present invention.

The uppermost guiding rollers (565*b*), and the uppermost guiding wheel (565*a*) can be designated as an "uppermost guiding means" for a generic definition.

What is claimed is:

1. A penta-fold automatic umbrella comprising:

a central shaft (1) including: a lower tube (11) having a grip (12) secured therewith, a first middle tube (13) slidably held on said lower tube (11), a second middle tube (13*a*) slidably held on said first middle tube (13), a third middle tube (13*b*) slidably held on said second middle tube (13*a*), an upper tube (14) slidably held on the third middle tube (13*b*) having an upper notch (15) fixed on a top of the upper tube (14), and a central sleeve (17) fixed in the shaft (1);

a rib assembly (2) including at least a top rib (21) pivotally secured to the upper notch (15), a stretcher rib (22) pivotally connected to the top rib (21) and a lower runner (23) slidably held on the upper tube, an intermediate rib (24) inwardly pivotally connected to said top rib (21), an inner connecting rib (25) pivotally connected to the stretcher rib (22), and said intermediate rib (24) outwardly pivotally connected to a middle connecting rib (28*a*) and a middle spring rib (27*a*), a tail rib (26) connected to an outer spring rib (27) and an outer connecting rib (28) with said outer spring rib (27) connected to the middle connecting rib (28*a*) and with said outer connecting rib (28) connected to the middle spring rib (27*a*), and an inner spring rib (27*b*) juxtapositioned to said intermediate rib (24) and connected between the top rib (21) and the middle connecting rib (28*a*);

an opening spring (3) resiliently retained in said central shaft (1) for opening the umbrella;

a plurality of closing springs (4) resiliently retained on said rib assembly (2) for closing the umbrella; and a control means (5) including a push button (51) resiliently held in the grip (12), an upper latch (52*a*)

normally locking the rib assembly (2) and the central shaft (1) at a closed state and operatively actuated for extending the rib assembly (2) and the shaft (1) for opening the umbrella, a closing controller (53) having a lower latch (54) formed on an anti-false operation safety means (57) resiliently held in the grip and the lower latch (54) operatively depressible by the push button (51) for unlocking a locking head (551) for closing the umbrella from an opened umbrella, said locking head (551) secured to a lower rope (56*a*) deflectively wound on a sliding pulley (P2) slidably held in said central sleeve (17) and said lower rope (56*a*) forming two folds of the penta-fold umbrella, and an upper rope (56*b*) having an inner rope end connected to said sliding pulley (P2), with said upper rope (56*b*) deflectively wound on an upper guiding roller (563) rotatably mounted on an upper portion of the upper tube (14), then downwardly directed from said upper guiding roller (563) to be wound on a lower guiding roller (564) rotatably mounted on said lower runner (23) and then deflected upwardly to be wound on an uppermost guiding means rotatably mounted on a top of said upper tube (14) above said upper guiding roller (563) and finally deflected downwardly to have an outer rope end of said upper rope (56*b*) fixed on said lower runner (23), with said upper rope (56*b*) forming triple folds of the penta-fold umbrella; thereby forming an umbrella with total penta folds by said lower rope (56*a*) and said upper rope (56*b*).

2. An automatic umbrella according to claim 1, wherein said outer spring rib (27) is juxtapositionally coupled to said outer connecting rib (28) by a coupling (29), said coupling (29) including: a pivot (291) formed on a base of the coupling (29) for pivotally securing the coupling on the outer connecting rib (28), a pin (292) formed on an end of the coupling for pivotally connecting a middle loop formed on a middle portion of the outer spring rib (27), and a seat portion (293) formed on a central portion of the coupling (29) for resting the outer spring rib (27) on the outer connecting rib (28) when the umbrella is folded.

3. An automatic umbrella according to claim 1, wherein said intermediate rib (24) includes a U-shaped guiding member (24*u*) retained in a middle portion of the intermediate rib (24) by a crimped lug (241) bent from an edge portion of the intermediate rib (24) for slidably holding the inner spring rib (27*b*) in the guiding member (24*u*) fixed on the intermediate rib (24).

4. An automatic umbrella according to claim 1, wherein said central shaft (1) includes: the lower tube (11) having an upper enlarged portion (112) having a cross section of hexagonal shape with six recesses (V) slightly concave inwardly to be engageable with the first middle tube (13) having a cross section of hexagonal shape with six recesses (V) slightly concave inwardly, the first middle tube (13) having an upper enlarged portion (132) having a cross section of general cross shape having four recesses (V) diagonally recessed inwardly towards an axis (10) of the shaft (1) to be engageable with the second middle tube (13*a*) having a cross section of general cross shape having four recesses (V) diagonally recessed inwardly towards the axis (10) and having a lower tube end (131) tapered downwardly to have a cross section of circular shape to be engageable with the lower tube (11) with circular shape, the second middle tube (13*a*) having a lower tube end (131*a*) tapered downwardly and having a cross section of hexagonal shape to be engageable with the first middle tube (13) and having an upper enlarged portion (132*a*) having a cross section of two-lobe shape with two recesses (V) recessed diametrically towards the axis (10) to be engageable with the third middle tube (13*b*) having a cross section of two-lobe shape, the third middle tube (13*b*) having a lower tube end (131*b*) tapered downwardly to have a cross section of general cross shape having four recesses (V) diagonally recessed inwardly to be engageable with the second middle tube (13*a*) and having an upper enlarged portion (132*b*) having a cross section of circular shape to be engageable with the upper tube (14) having a cross section of circular shape, and the upper tube (14) having a lower tube end (141) tapered downwardly to have a cross section of two-lobe shape having two recesses (V) diametrically recessed inwardly to be engageable with the third middle tube (13*b*).

5. An automatic umbrella according to claim 1, wherein said control means (5) includes: said push button (51) resiliently held in a button hole (120*a*) formed in the grip (12) having said upper latch (52*a*) integrally formed on a ring portion (511) which is slidably held in at least a guiding groove (124) transversely recessed in an inside wall of the grip (12), with the ring portion (511) tapered from the push button (51) from a first side (A) of the central shaft (1) towards a second side (B) of the shaft (1) to form a pair of reinforced side-wing portions (51*a*) disposed on opposite sides of the push button (51) and each wing portion (51*a*) defined between the push button (51) and the ring portion (511), and having the upper latch (52*a*) operatively actuated when simultaneously depressing the push button (51) for opening the umbrella, said closing controller (53) having said lower latch (54) resiliently secured on an anti-false operation safety means (57) resiliently held in the grip (12) and the lower latch (54) being operatively depressible by the push button (51) for inwardly pushing said locking head (551), which is secured with said lower rope (56*a*) slidably wound in the central sleeve (17) with the lower rope (56*a*) connectable with said upper rope (56*b*) which is deflectively linked among an upper portion of the upper tube (14) including said upper guiding roller (563) and said uppermost guiding means (565*b*, 565*a*), the lower runner (23) including the lower guiding roller (564) and the central sleeve (17), for disengaging the locking head (551) from a detent protrusion (111*a*) formed in a lower portion (111) of the lower tube (11), thereby allowing each said closing spring (4) to be restored to release its pre-stored elastic energy for closing the umbrella from an opened state, with the anti-false operation safety means (57) having an elongated cylinder (571) lowered by the middle tubes (13, 13*a*) after closing the umbrella to lower the latch (54) to prevent a false depression of the closing controller (53) without being depressed by the push button (51).

6. An automatic umbrella according to claim 5, wherein said closing controller (53) includes: the lower latch (54) resiliently secured to a lower portion of an elongated cylinder (571) of the anti-false operation safety means (57), with the elongated cylinder (571) resiliently raised upwardly as urged by a tension spring (57*a*) which is retained in a bottom spring socket (573) recessed in a bottom of the cylinder (571) to position the lower latch (54) in between the push button (51) and said locking head (551) secured with the lower rope (56*a*) when opening the umbrella, with the central hole (511*a*) in the ring portion (511) allowing an upwardly moving of the cylinder (571) and the lower latch (54) as urged by the tension spring (57*a*) after opening the umbrella to extend the upper and middle tubes upwardly and raise the runner (23), whereby upon depression of the push button to inwardly push the lower latch (54) and the locking head (551), the locking head (551) will be disengaged from the detent protrusion (111*a*) in the lower tube (11) for closing an umbrella from an opened state.

7. An automatic umbrella according to claim 1, wherein said lower rope (56*a*) has a lower rope end (561*a*) secured to the locking head (551) and an upper rope end (562*a*) secured to a lower plug (P1) retained at a bottom (170*a*) of the central sleeve (17); with the lower rope (56*a*) extending upwardly from the locking head (551), passing through a rope hole formed through the lower plug (P1), an interior in the central sleeve (17), then deflectively wound on a miniature roller (R) rotatably secured in a sliding pulley (P2) slidably held in the central sleeve (17), and finally downwardly secured to the lower plug (P1).

8. An automatic umbrella according to claim 1, wherein said upper rope (56*b*) includes: an inner rope end (561*b*) secured to a sliding pulley (P2) slid in said central sleeve (17), an outer rope end (562*b*) fixed to the lower runner (23), said upper guiding roller (563) rotatably mounted in an inner block (151) secured in an upper portion of the upper tube (14) for slidably guiding the upper rope (56*b*) from an interior of the central sleeve (17) held in a central portion of the shaft (1), with the upper rope (56*b*) wound on the upper guiding roller (563) and then deflected downwardly towards the lower runner (23) to be wound on said lower guiding roller (564) rotatably mounted on the lower runner (23), said uppermost guiding means including a pair of uppermost guiding rollers (565*b*) respectively rotatably mounted in opposite portions of the inner block (151) positioned above the upper guiding roller (563) for winding the upper rope (56*b*), as upwardly directed from the lower guiding roller (564), on the two uppermost guiding rollers (565*b*) for disposing the upper rope (56*b*) on opposite outer surfaces of the upper tube (14) for dynamically balancing a rope stroke when operating the umbrella, and with the outer rope end (562*b*) downwardly directed to be fixed to the lower runner (23).

9. An automatic umbrella according to claim 1, wherein said uppermost guiding means is an uppermost guiding wheel (565*a*) rotatably mounted in a top of the shaft (1) for winding the upper rope (56*b*) thereon and for disposing the upper rope on opposite outer surfaces of the upper tube (14).

10. A penta-fold automatic umbrella comprising:

a central shaft (1) including: a lower tube (11) having a grip (12) secured therewith, a first middle tube (13) slidably held on said lower tube (11), a second middle tube (13*a*) slidably held on said first middle tube (13), a third middle tube (13*b*) slidably held on said second middle tube (13*a*), an upper tube (14) slidably held on the third middle tube (13*b*) having an upper notch (15) fixed on a top of the upper tube (14), and a central sleeve set (17*a*) fixed in the shaft (1);

a rib assembly (2) including at least a top rib (21) pivotally secured to the upper notch (15), a stretcher rib (22) pivotally connected to the top rib (21) and a lower runner (23) slidably held on the upper tube, an intermediate rib (24) inwardly pivotally connected to said top rib (21), an inner connecting rib (25) pivotally connected to the stretcher rib (22), and said intermediate rib (24) outwardly pivotally connected to a middle connecting rib (28*a*) and a middle spring rib (27*a*), a tail rib (26) connected to an outer spring rib (27) and an outer connecting rib (28) with said outer spring rib (27) connected to the middle connecting rib (28*a*) and with said outer connecting rib (28) connected to the middle spring rib (27*a*), and an inner spring rib (27*b*) juxtapositioned to said intermediate rib (24) and connected between the top rib (21) and the middle connecting rib (28*a*);

an opening spring (3) resiliently retained in said central shaft (1) for opening the umbrella;

a plurality of closing springs (4) resiliently retained on said rib assembly (2) for closing the umbrella; and a control means (5) including a push button (51) resiliently held in the grip (12), an upper latch (52*a*) normally locking the rib assembly (2) and the central shaft (1) at a closed state and operatively actuated for extending the rib assembly (2) and the shaft (1) for opening the umbrella, a closing controller (53) having a lower latch (54) formed on an anti-false operation safety means (57) resiliently held in the grip and the lower latch (54) operatively depressible by the push button (51) for unlocking a locking head (551) for closing the umbrella from an opened umbrella, said locking head (551) secured to a drag rod (55) slidably held in the central sleeve set (17*a*), with said drag rod (55) forming a fold in the shaft of the penta-fold umbrella; and an upper rope (56*b*) having an inner rope end coupled to said drag rod (55), with said upper rope (56*b*) deflectively wound on an upper guiding roller (563) rotatably mounted on an upper portion of the upper tube (14), then downwardly directed from said upper guiding roller (563) to be wound on a first lower guiding roller (564) rotatably mounted on a first side of said lower runner (23) and then deflected upwardly to be wound on an uppermost guiding means rotatably mounted on a top of said upper tube (14) above said upper guiding roller (563) and then deflected downwardly to be wound on a second lower guiding roller (564') rotatably mounted on a second side of the runner (23) and finally having an outer rope end of said upper rope (56*b*) extended upwardly to be fixed on said upper notch (15), with said upper rope (56*b*) forming quadruple folds of the penta-fold umbrella.

11. An automatic umbrella according to claim 10, wherein said uppermost guiding means includes a pair of uppermost guiding rollers (565*b*) respectively rotatably mounted in opposite portions of the inner block (151) above the upper guiding roller (563) for winding the upper rope (56*b*) as upwardly directed from the first lower guiding roller (564) on the runner (23) on the two uppermost guiding rollers (565*b*) for disposing the upper rope (56*b*) on opposite outer surfaces of the upper tube (14) for dynamically balancing a rope stroke when operating the umbrella.

12. An automatic umbrella according to claim 10, wherein said uppermost guiding means includes an uppermost guiding wheel (565*a*) having a diameter generally equal to a diameter of the upper tube (14) and rotatably mounted on the top of the upper tube (14) for symmetrically disposing an outer rope section of the upper rope (56*b*) on opposite sides of the wheel (565*a*) and disposed on opposite outer surfaces of the upper tube (14).

* * * * *